United States Patent [19]

Hastings

[11] 4,381,081

[45] * Apr. 26, 1983

[54] NOZZLE ASSEMBLY FOR SPRAY COATING SYSTEMS

[75] Inventor: Donald R. Hastings, Elyria, Ohio

[73] Assignee: Nordson Corporation, Amherst, Ohio

[ * ] Notice: The portion of the term of this patent subsequent to Jun. 16, 1998, has been disclaimed.

[21] Appl. No.: 199,487

[22] Filed: Oct. 22, 1980

Related U.S. Application Data

[63] Continuation-in-part of Ser. No. 971,514, Dec. 20, 1978, Pat. No. 4,273,293.

[51] Int. Cl.[3] ..... B05B 5/02

[52] U.S. Cl. ..... 239/707; 239/424

[58] Field of Search ..... 239/424, 425.5, 290, 239/296, 299, 300, 704, 705, 706, 707, DIG. 19, 239/591

[56] References Cited

U.S. PATENT DOCUMENTS 4,273,293 6/1981 Hastings ..... 239/707 X 4,294,411 10/1981 Hastings et al. ..... 239/707

*Primary Examiner*—Andres Kashnikow

*Assistant Examiner*—Gene A. Church

*Attorney, Agent, or Firm*—Wood, Herron & Evans

[57] ABSTRACT

An air atomizing nozzle assembly for spray coating systems such as an electrostatic spray gun is disclosed. The nozzle assembly includes an air cap having a central bore which surrounds a fluid tip nozzle. The bore has a plurality of uniformly dimensioned axially aligned gas flow passages evenly spaced about its circumference and a plurality of radially inwardly extending ribs therebetween. The ribs engage the outside surface of the fluid tip nozzle to positively align its center axis on the axis of the central bore. The air cap and nozzle tip thus cooperate to form a plurality of uniform gas flow passages around the nozzle thereby producing a finely atomized uniform spray pattern of coating material emitted from the fluid tip. In a preferred embodiment of the invention, the gas flow passages and ribs are formed in a metal element inserted in a center bore in the air cap. The metal element is so dimensioned that the ribs make a press fit with the fluid tip to positively align it. The air cap is retained in a one-piece resilient retaining ring by snapping the air cap into position over an annular lip of the ring. The air cap and retaining ring form a seal which prevents control air from escaping to the atmosphere.

9 Claims, 13 Drawing Figures

NOZZLE ASSEMBLY FOR SPRAY COATING SYSTEMS

CROSS REFERENCE TO RELATED APPLICATIONS

This application is a continuation-in-part of Ser. No. 971,514 filed Dec. 20, 1978 now U.S. Pat. No. 4,273,293.

BACKGROUND OF THE INVENTION

This invention relates to spray coating systems and particularly to an improved nozzle assembly for spray coating guns. More specifically, this invention relates to an external air atomizing nozzle assembly for electrostatic spray guns such as that disclosed in Hastings et al U.S. Pat. No. 3,747,850 issued on July 24, 1973, and assigned to the assignee of this invention.

In conventional electrostatic spray systems, a fluid coating material such as paint, varnish, lacquer and the like is passed through the barrel of a spray gun, into a fluid tip which is threaded at its rear into a counterbore in the forward end of the barrel, and through and out of a small diameter nozzle at the forward end of the fluid tip. An air cap surrounds the forward end of the fluid tip and includes a central bore surrounding the nozzle so as to define an annular air passage around the fluid nozzle. Air issuing from this annular passage impacts with the stream of material issuing from the material orifice of the nozzle to at least coarsely atomize the material stream. There may be additional openings or ports in the air cap to further atomize or control the material stream as well as a pair of fan-shaping ports located in a pair of opposed horns of the air cap. A trigger operated valve controls the flow of air through the atomizing air passage, and a manually adjustable valve controls the amount of air issuing from the horn of the nozzle and thus the degree of "fan" formed by the atomized spray. Patents generally illustrating such systems are U.S. Pat. Nos. 1,655,254; 2,101,175; 2,138,300; 3,672,569; and 3,747,850.

In such systems, it is of utmost importance that the annular air passage defined by the wall of the central bore in the air cap and the outside diameter of the fluid tip nozzle be accurately concentric with the material orifice of the nozzle. If this concentricity deviates by as little as one or two one-thousandths of an inch, atomization of the material becomes non-uniform and the shape of the spray emitted from the gun becomes badly distorted. Because the fluid tip is supported at its rearward end or at an intermediate position still removed from the nozzle, it is extremely difficult to obtain the accurate alignment of the nozzle in the central bore. This is particularly true when the nozzle assembly is formed of a nonconductive material such as plastic since it is particularly difficult to manufacture plastic parts in the tolerances required to achieve concentricity.

The problem of controlling the atomization of the fluid material and the shape of the spray emitted from the gun increases as the flow rate of material through the gun decreases. In sum, very small variations in the annular air passage surrounding the fluid tip nozzle have been found to have very drastic effects on the shape of the spray pattern emitted from the gun.

SUMMARY OF THE INVENTION

It has been among the principal objects of this invention to provide an atomizing nozzle for a spray coating gun having improved relative concentricity between the material orifice at the forwardmost end of the fluid tip and the atomizing opening in the center of the air cap to obtain improved control and uniformity of the material spray pattern.

It has been a further objective of this invention to obtain such improved control and uniformity of material spray pattern particularly in a nozzle assembly formed of a nonconductive material for an electrostatic spray gun.

It has been another objective of this invention to obtain exceptionally wide fan patterns from an electrostatic spray gun at low flow rates, i.e., fans up to 20 inches in width at a 10-inch nozzle-to-workpiece distance with flow rates in the range of $1\frac{1}{2}$ to 6 ounces of coating material per minute.

It has been a still further objective of this invention to provide a nozzle assembly for an electrostatic spray gun which is rugged in construction and relatively simple to manufacture but which accurately aligns the nozzle in the central bore of the air cap to achieve uniformity in spray pattern and fine atomization.

These objects and others of the present invention are achieved by providing an improved nozzle assembly for a spray coating gun including a fluid tip and an air cap which cooperate to form a multiplicity of uniformly dimensioned, evenly spaced atomizing gas flow channels. Gas passing through these channels or passages converges symmetrically against the material emitted from the fluid tip nozzle to transform the material stream into a uniform and finely atomized pattern. The nozzle assembly of this invention provides a uniform spray pattern even when the nozzle is formed of a plastic material and when the material flow rates are low.

In accordance with one embodiment of the invention, the fluid tip is threaded at its rear into a counterbore in the forward end of the barrel of the electrostatic spray gun and includes a nozzle portion through which the coating material passes. The air cap has a central bore through which a gas, e.g., air, is ejected for atomizing the coating material. The air cap further includes a number of uniformly dimensioned, axially aligned gas flow passages which are evenly spaced about the circumference of the bore. Spaced, radially inwardly extending ribs are located between the gas flow passages. The ribs engage the outside surface of the liquid coating tip nozzle to thereby positively align the center axis of the material orifice of the nozzle on the axis of the central bore. The fluid tip is thereby supported at its rear end by the barrel and at its forward or nozzle end by the ribs in the central bore of the air cap. The air cap and nozzle tip thus cooperate to form a plurality of air flow passages of uniform dimension around the nozzle to thereby produce a uniform atomizing air flow pattern around the nozzle.

In a presently preferred embodiment of the invention, the nozzle assembly is made of an electrically non-conductive plastic material and contains a central opening of a size to receive a relatively small metal insert, e.g., an insert formed of pressed and sintered brass or aluminum. In this embodiment, the metal insert is formed with the central bore having the circumferentially spaced gas flow passages and radially inwardly extending ribs for engaging the outside surface of the fluid tip nozzle. Preferably, the ribs are so dimensioned that a press fit occurs between the metal ribs and the plastic nozzle when the nozzle is inserted into the center bore of the insert. Use of the metal insert provides for resistance against wear and deformation of the ribs as the nozzle assembly is repeatedly disassembled and reassembled on cleaning. It has been found further that the amount of metal used in the insert is so small that it does not present any problems in use with an electrostatic spray gun.

Another aspect of this invention is predicated upon sealing the circumference of the air cap to prevent excessive leakage of gas to the atmosphere. That is, in prior art nozzles, the air cap was sealed by a series of washers and a relatively flimsy ring. These washers were easily deformed by pressure and temperature and thus failed to effectively seal around the air cap.

This invention includes as part of the nozzle assembly a retaining ring having a rigid annular sealing lip. The air cap includes an annular groove on the outer surface thereof which receives the annular lip by snapping the air cap into position over the annular lip. The air cap and ring thus forms a seal which prevents excessive air from escaping air to the atmosphere. This aspect of the invention thus eliminates the need for washers making the nozzle assembly less expensive to manufacture and assemble, more compact and more effectively sealed.

These and other objects and advantages of this invention will be more readily apparent from the following detailed description of the invention taken with the accompanying drawings.

DETAILED DESCRIPTION OF THE INVENTION

Figure 1:
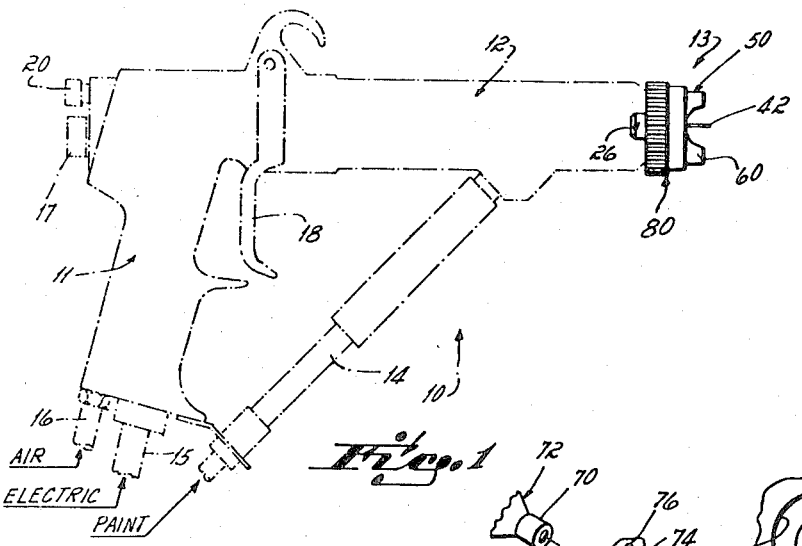
FIG. 1 is a side elevational view showing in phantom a manually operated electrostatic air spray gun incorporating the nozzle assembly of this invention (shown in solid)

The gun 10 illustrated in FIG. 1 of the drawings is an air operated electrostatic spray gun which relies upon the impact of an air stream with a liquid stream to effect atomization of the liquid stream. While the invention is described as applied to an air gun, it should be understood, though, that the invention is equally applicable to all electrostatic spray guns or to spray coating systems in general.

The gun 10 shown in phantom in FIG. 1 is described in detail in the Hastings et al U.S. Pat. No. 3,747,850, which disclosure is incorporated herein by reference. The gun is generally described here only for purposes of illustrating the application of the present invention, and those skilled in the art are referred to the aforementioned patent for the details of its construction and operation.

The gun 10 comprises an electrically conductive metal handle assembly 11, an electrically insulative barrel assembly 12, and an insulative nozzle assembly 13. Paint or other spray material which may be in the nature of a coating, varnish or lacquer (referred to in regard to this invention generically as paint or coating material) is supplied to the gun from an external reservoir or tank (not shown) through a material passage 14. A high voltage source of electrical energy is supplied to the gun by a cable 15 from an external electrical power pack (not shown).

The handle assembly 11 is generally made from a metal casting and includes an air inlet 16, a trigger actuated internal air flow control valve 17 and a trigger 18 for controlling the flow of air through the valve 17. There is also an adjustable air valve 20 in the gun handle for controlling the shape or "fan" of the spray emitted from the gun.

Figure 4:
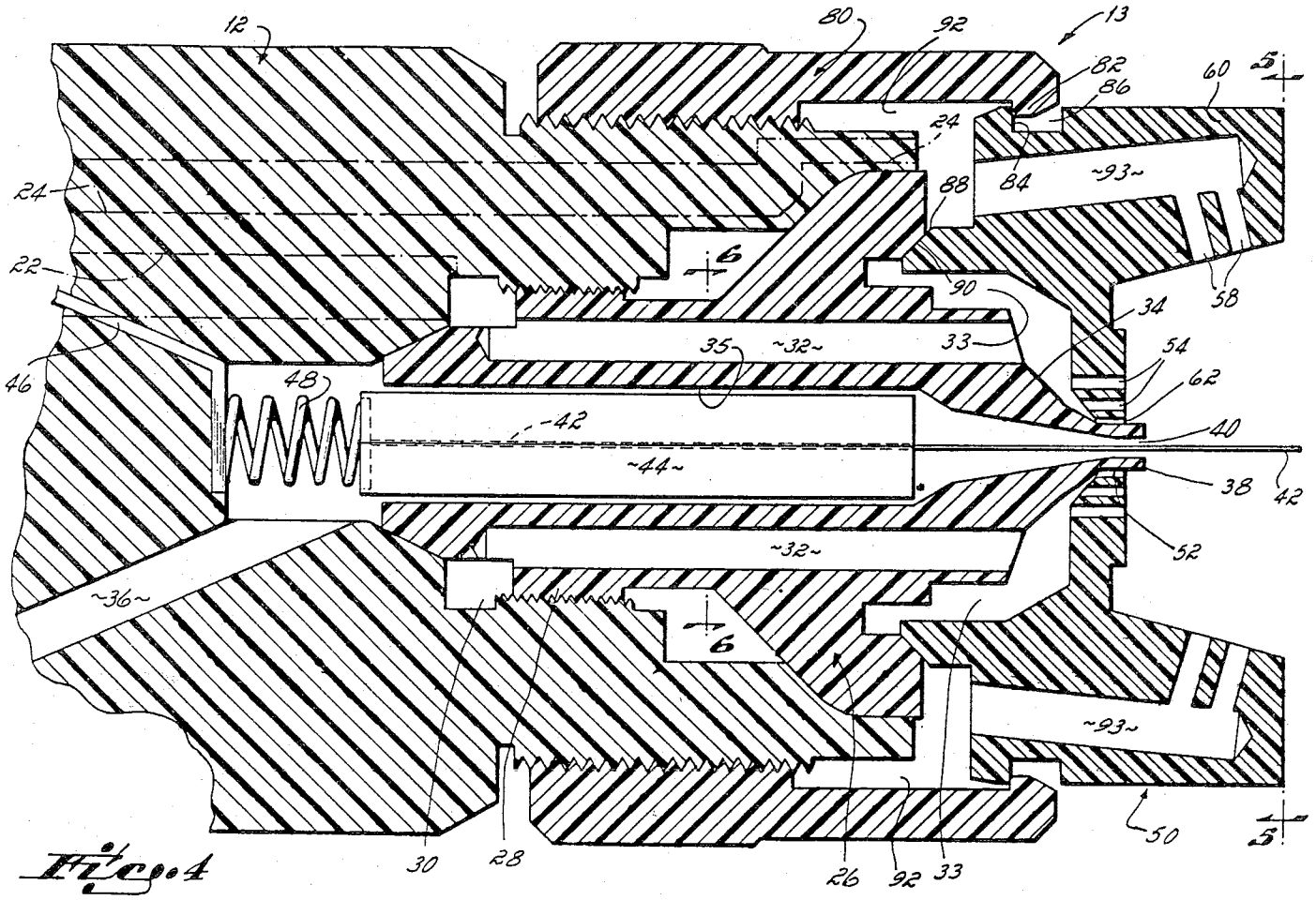
FIG. 4 is an axial cross sectional view of the nozzle assembly of this invention.

The air inlet 16 opens into a generally vertical air passage in the handle 11 which communicates through the air flow control valve 17 with a pair of internal passage 22, 24 passing through the barrel 12 of the gun and terminating at the forward end of the barrel 12 (FIG. 4). The passage 22 provides atomizing air while passage 24 provides the fan-shaping air. The flow of air through passages 22, 24 is controlled by the trigger operated air control valve 17 while the flow of fan air through the passage 24 is further controlled by the fan control valve 20.

Figure 2:
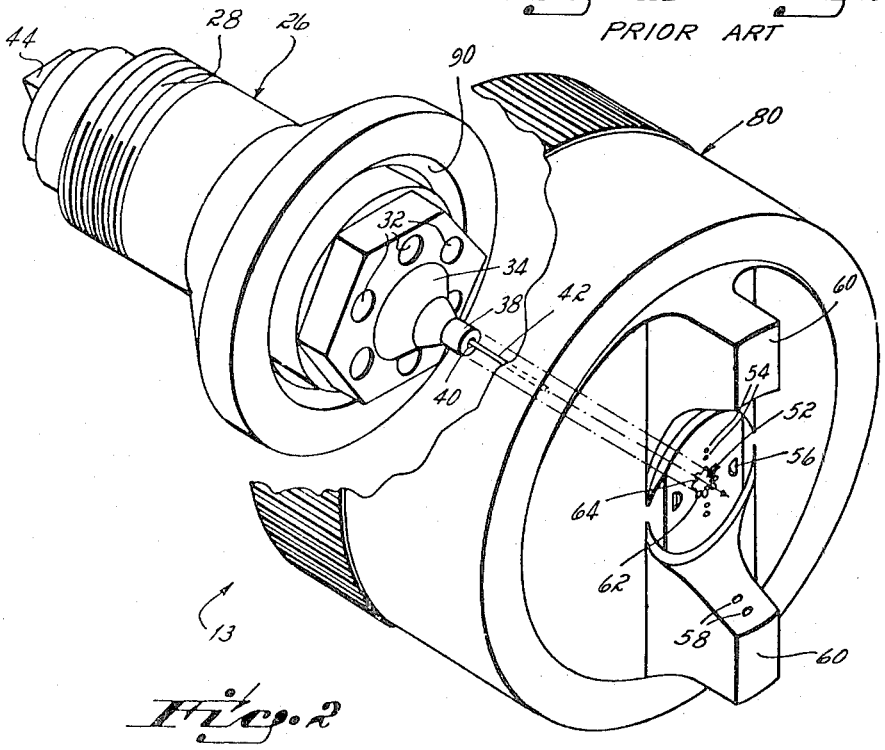
FIG. 2 is an exploded perspective view with part broken away of the nozzle assembly of this invention.

Referring now to FIGS. 2 and 4, the nozzle assembly 13 is made from an electrically non-conductive material. It has a fluid tip 26 which is threaded at its rear 28 into a counterbore 30 in the forward end of the barrel 12. The fluid tip 26 has six circumferentially spaced axial passages 32 which open into the rear of the counterbore 30 which in turn communicate with the air passage 22 such that atomizing air passing through the passage 22 may enter and pass through the axial passages 32 in the fluid tip and into an internal chamber 33 surrounding the forward end 34 of the fluid tip. The fluid tip 26 also has a central axial passage 35 communicating with a material flow passage 36 in the gun 10 for supply of liquid or fluid via the inclined passage 14 (FIG. 1) from the tank or reservoir.

The forward end 34 of the fluid tip 26 terminates in a nozzle 38 having a small diameter orifice 40 through which the coating material is emitted.

Figure 6:
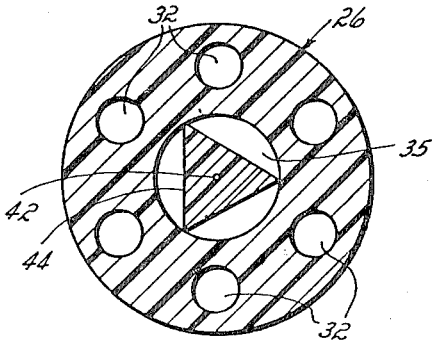
FIG. 6 is a cross sectional view taken on line 6—6 of FIG. 4.

A material charging electrode or antenna 42 is mounted on the center axis of the fluid tip and is held in place in the passage 35 by means of a non-conductive holder 44 (FIG. 6). Electrical power is supplied to the electrode 42 which protrudes from the orifice 40 of the nozzle 38. This power is supplied generally from the electrical power pack which is connected to the gun via a cable 15 which is connected to the electrode 42 via an insulated cable 46 and spring 48.

Figure 5:
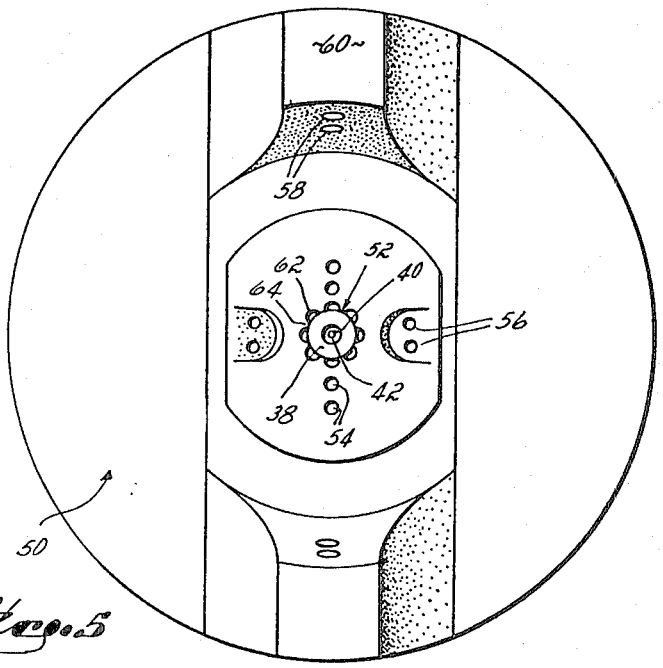
FIG. 5 is an end elevational view taken on line 5—5 of FIG. 4.

The air cap 50 surrounds the forward end 34 of the fluid tip 26. It includes a central bore 52 through which the nozzle 38 extends, two pair of fan control ports 54 located on either side of the bore 52, two pair of recessed fine atomizing ports 56, and a pair of ports 58 in each air horn 60. Referring now in addition to FIG. 5, the air cap 50 further has a number of uniformly dimensioned, circumferentially spaced gas flow passages 62 whose axes are aligned with the axis of the central bore 52. These passages 62 define a series of circumferentially spaced axial gas flow passages with spaced, radially extending ribs 64 therebetween. The nozzle portion 38 of the fluid tip 26 extends through the central bore 52 and the ribs 64 engage its outside surface. The ribs thereby positively align the nozzle such that the center axis of the material orifice 40 is on the center axis of the central bore 52. The co-action of the fluid tip nozzle with the air cap thus provides a plurality of uniformly dimensioned air flow passages uniformly spaced around the fluid tip nozzle thereby producing a uniform atomizing air flow pattern.

Figure 3A:
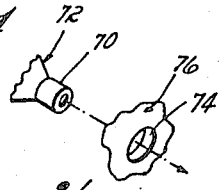
FIG. 3A is a partial exploded perspective view of a prior art nozzle.
Figure 3B:
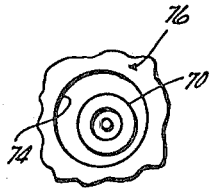
Fig. 3B PRIOR ART
FIG. 3B is an end view of the prior art nozzle shown in FIG. 3A.

This co-action may be further understood and appreciated by referring to FIGS. 3A and 3B wherein a prior art nozzle assembly is illustrated. Referring first to FIG. 3A, in the prior art, the nozzle end 70 of the fluid tip 72 extends through a central bore 74 in the air cap 76 which has a diameter greater than the outside diameter of the nozzle 70 to form an annular air passage around the nozzle. However, in the prior art, the fluid tip 72 is supported at points removed from the nozzle end 70 and because of inaccuracies in manufacture and dimensional instability of materials, it is rarely aligned in the central bore to provide a uniform annular air passage. Rather the misalignment of the nozzle in the central bore, as illustrated in FIG. 3B, results in a lack of concentricity of the air passage 74 about the nozzle; and, therefore, non-uniform atomization of the material exiting the nozzle results. As may be best seen in FIG. 5, the nozzle assembly of the present invention by virtue of the cooperation of the air cap 50 with the fluid tip nozzle 38 provides uniformly dimensioned, spaced air flow of passages 62 around the nozzle.

The air cap 50 is mounted to the gun 10 by means of an annular retaining ring 80. The retaining ring 80 is also made from an electrically non-conductive plastic material. It is threaded over a threaded section of the barrel 12 at one end and at its other end has an annular lip 82. The retaining ring 80 although rigid is sufficiently flexible at the lip 82 to permit the air cap 50 to be snapped into position with the lip 82 engaging a wall 84 in an annular groove 86 in the outside surface of the air cap 50 such that the air cap is securely retained and sealed against escape of air to the atmosphere.

The air cap 50 and fluid tip 26 include mating frustoconical surfaces 88 and 90, respectively, which seal the atomizing air in chamber 33 from the fan-shaping air in an annular chamber 92 when the retaining ring 80 is securely tightened on the barrel. The chamber 92 communicates with the air passage 24 and with passages 93 in the air horns 60 in turn communicating with ports 58.

Referring now to FIGS. 7–10, there is shown another embodiment of the present invention wherein the air cap 50 includes a ceramic insert 94 which is mounted in the center of the air cap. In the embodiment shown in FIGS. 7 and 8, the ceramic insert 94 includes a central bore 96, a plurality of uniformly dimensioned, circumferentially spaced gas flow passages 98 axially aligned with the central bore, and radially inwardly extending radial ribs 100 therebetween, as heretofore described.

Figure 7:
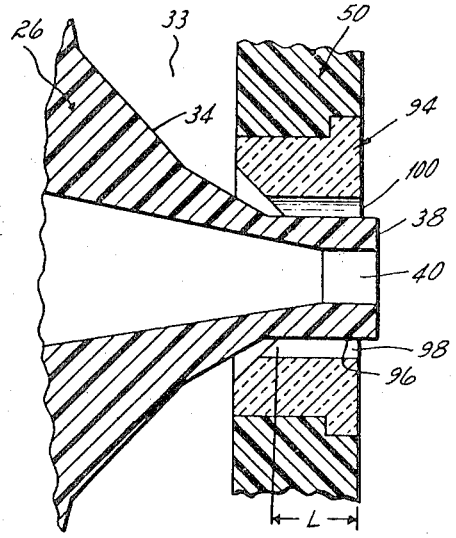
FIG. 7 is a cross sectional view of another embodiment of this invention.
Figure 8:
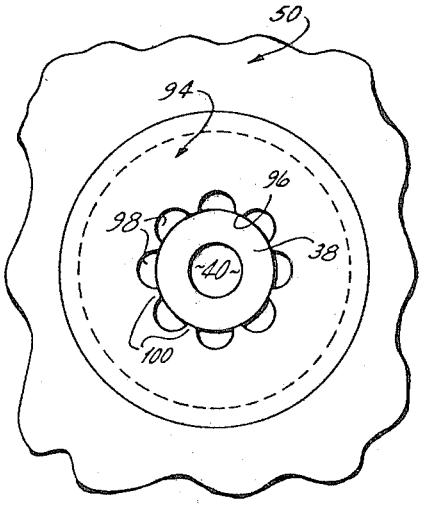
FIG. 8 is an end elevational view of the nozzle assembly shown in FIG. 7.

In the embodiment shown in FIGS. 7 and 8, the axial length L of the ribs 100 is about 0.060 inch and the nozzle extends approximately 0.025 inch past the outer surface of the air cap. Eight holes of about 0.031 inch in diameter are equally spaced on a 0.103 inch diameter. The diameter of the central bore is also about 0.103 inch. The ribs have a width of about 0.008 inch.

Figure 9:
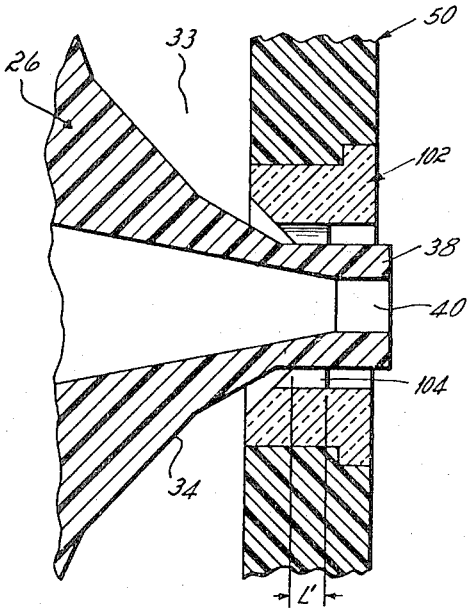
FIG. 9 is a cross sectional view of another embodiment of this invention.
Figure 10:
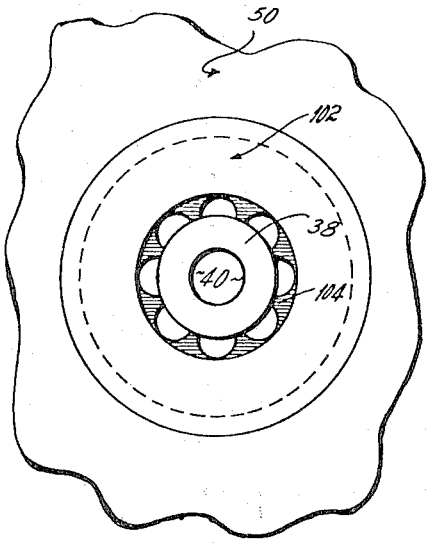
FIG. 10 is an end elevational view of the nozzle assembly shown in FIG. 9.

In the embodiment shown in FIGS. 9 and 10, a like ceramic insert 102 is shown but with the difference being that axial length L′ of the ribs 104 is decreased to about 0.020 to 0.040 inch. The use of the ceramic inserts as shown in FIGS. 7–10 is advantageous from a manufacturing standpoint. The use of the ribs of shorter axial length shown in FIGS. 9–10 is advantageous where heavier viscosity materials are employed or better air contact is desired.

Figure 11:
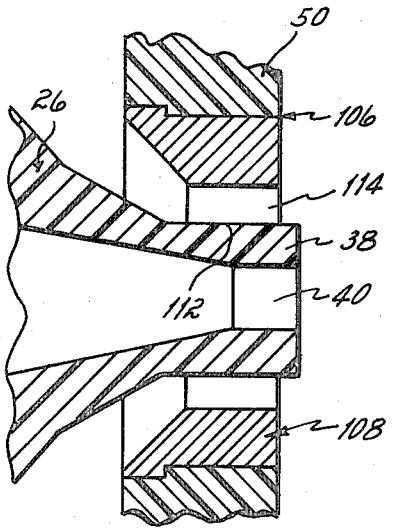
FIG. 11 is a cross sectional view of another embodiment of this invention.
Figure 12:
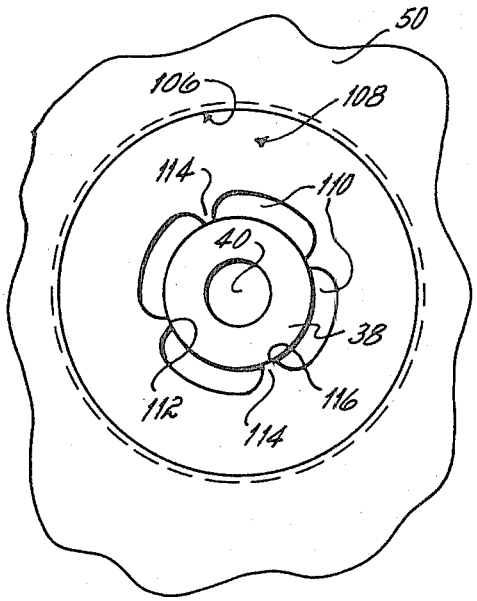
FIG. 12 is an end elevational view of the nozzle assembly shown in FIG. 11.

In the embodiment shown in FIGS. 11 and 12, the air cap 50 is provided with a central bore 106 in which is mounted a circular insert 108. The insert 108 is preferably formed of a pressed and sintered metal powder such as brass and aluminum and is so dimensioned with respect to the central bore 106 that when inserted therein, the plastic material of the air cap 50 is slightly compressed to form a tight press fit therebetween. The insert 108 has four like gas flow passages 110 spaced about the circumference of a central bore 112 therein with radially inwardly extending ribs 114 therebetween. As in the prior embodiments, the gas flow passages 110 are axially aligned with the axis of the samll diameter orifice 40 of the nozzle portion 38 of the fluid tip 26. As may be seen, the ribs 114 include lands 116 which lie on the circumference of the bore 112 and which engage the outside surface of the nozzle 38. Preferably, the diameter of the central bore 112 is smaller by a few thousandths of an inch than the outside diameter of the nozzle 38. Accordingly, when the nozzle 38 is inserted in the bore 112, a press fit is achieved between the outside surface of the nozzle 38 and the lands 116 of the ribs 114. The nozzle 38 is thereby positively aligned in the bore 112. Referring to FIG. 11, it may be seen that the axial length of the ribs 114 is approximately half the thickness of the insert 108. This provides less resistance to flow of the atomizing gas through the passages 110.

By making the insert from pressed and sintered powdered metal, the tolerances on the order of 0.001 inch can be maintained. Moreover, the nozzle assembly can be disassembled and reassembled, for example, for cleaning, and the nozzle 38 inserted and removed from between the ribs 114 without wearing or deforming the ribs since they are harder than the nozzle material. Accordingly, the insert will maintain its dimensions over a relatively long period of use. Further, it has been found that the amount of metal needed in the insert is relatively small and does not adversely affect the operation of an electrostatic spray gun.

Although the invention has been described in terms of certain preferred embodiments, those skilled in the art will recognize that other forms may be adopted within the scope of the invention. Moreover, those skilled in the art will appreciate that although the invention has been described in terms of electrostatic spraying, it is equally applicable to spray apparatus in general.

I claim:

1. In a system for the coating the articles with a liquid coating material supplied from a pressurized bulk coating source wherein said liquid coating material is emitted from a coating material spray device in the form of an atomized spray produced by impacting a central stream of liquid coating material under pressure with a pressurized gas stream encircling said central liquid stream and wherein the articles to be coated are spaced from said spray device, the combination comprising:

a source of liquid coating material under pressure;

a source of pressurized atomizing gas;

a material spray device having a liquid conduit with flow control means therein adapted to be connected to said source of pressurized liquid coating material for providing relatively low liquid coating material flow rates in the approximate range of $1\frac{1}{2}$–6 fluid ounces of material per minute, and having a gas conduit therein adapted to be connected to said source of pressurized atomizing gas; and a spray coating nozzle assembly made which is substantially constructed of non-conductive plastic material comprising a liquid tip communicating with said liquid conduit and having a nozzle portion through which said liquid coating material is emitted in a central stream at said relatively low flow rate, and an air cap communicating with said atomizing gas conduit through which gas is ejected for impinging and atomizing said central stream of liquid coating material emitted from said nozzle portion of said liquid tip, said air cap being positionably supported by said spray device only in the rear region of said air cap to effectively leave the forward region thereof positionably unsupported by said spray device, said air cap having a metal insert in the center thereof, said insert having a central bore and a plurality of uniformly dimensioned and circumferentially spaced axial gas flow passages with spaced, radially inwardly extending ribs therebetween, said ribs engaging the outside surface of said liquid coating tip nozzle portion to positively align the center axis of said liquid coating nozzle portion on said axis of said central bore to provide uniform atomizing gas flow around said liquid coating tip nozzle portion for producing at relatively low flow rate a finely atomized uniform spray pattern of said coating material emitted from said liquid tip.

2. The system of claim 1 wherein said spray gun is an electrostatic spray gun and wherein said nozzle assembly includes a charging electrode protruding from the nozzle portion of said fluid tip.

3. The system of claim 1 further comprising an annular retaining ring receivable on the end of said gun having an annular lip engageable with an annular groove in the outer surface of said air cap to seat and retain said air cap on said fluid tip.

4. The system of claim 1 wherein the forward end of said fluid tip nozzle protrudes forwardly of the outer surface of said air cap.

5. The system of claim 1 wherein said cap includes a central bore and wherein said insert is press fitted therein.

6. The system of claim 1 wherein said insert has four equally spaced ribs.

7. The system of claim 1 wherein the diameter of said central bore of said insert is smaller than the outside diameter of said coating tip nozzle portion such that said nozzle portion is pressed between said ribs.

8. The system of claim 1 wherein said insert is formed of pressed and sintered metal powder.

9. The system of claim 1 wherein said air cap further includes fan-shaping ports communicating with a second chamber in turn communicating with a source of atomizing gas through said barrel, said second chamber being sealed from said atomizing gas chamber by mating annular surfaces of said air cap and said fluid tip, and means mounted in said material passage of said liquid tip and protruding from said nozzle for charging said material.

* * * * *

UNITED STATES PATENT AND TRADEMARK OFFICE

CERTIFICATE OF CORRECTION

PATENT NO. : 4,381,081

DATED : April 26, 1983

INVENTOR(S) : Donald R. Hastings

It is certified that error appears in the above-identified patent and that said Letters Patent is hereby corrected as shown below:

In column 6, line 26, "samll" should be --small--.

In column 6, line 62, "the" second occurrence, should be --of--.

Signed and Sealed this

*Nineteenth* Day of *July 1983*

[SEAL]

*Attest:*

GERALD J. MOSSINGHOFF

*Attesting Officer*

*Commissioner of Patents and Trademarks*